US005791228A

United States Patent [19]

Gervasi

[11] Patent Number: 5,791,228

[45] Date of Patent: Aug. 11, 1998

[54] TORQUE OR FORCE AMPLIFYING ACTUATOR AND METHOD FOR CONTROLLING ACTUATOR

[76] Inventor: Vito R. Gervasi, 3749 South Packard Ave. #11, St. Francis, Wis. 53235

[21] Appl. No.: 677,131

[22] Filed: Jul. 9, 1996

[51] Int. Cl.[6] ..... F15B 9/10

[52] U.S. Cl. ..... 91/375 R; 91/376 A

[58] Field of Search ..... 91/375 R, 376 A

[56] References Cited

U.S. PATENT DOCUMENTS

| | | | |
|---|---|---|---|
| 1,004,541 | 9/1911 | Martin | 91/378 |
| 2,171,005 | 8/1939 | McNeil et al. | 91/375 R |
| 2,735,406 | 2/1956 | Britton | 91/375 R |
| 2,825,307 | 3/1958 | Enyeart et al. | 91/376 R |
| 2,992,633 | 7/1961 | Stiglic et al. | 91/375 R |
| 4,950,028 | 8/1990 | Harrison . | |
| 4,977,816 | 12/1990 | Kuttruf . | |
| 5,467,800 | 11/1995 | Sallas . | |

*Primary Examiner*—F. Daniel Lopez
*Attorney, Agent, or Firm*—Teresa J. Welch; Stroud, Stroud, Willink, Thompson & Howard

[57] ABSTRACT

A hydraulic or pneumatic actuator wherein the movement of the power transfer shaft is controlled by a movable vent. The actuator is divided into two cells by a power transfer shaft to which is attached a vent follower. In an equilibrium position, the vent is closed off by the vent follower. Moving the vent location to either side of the vent follower causes fluid or gas to escape from one or the other cell. This creates a pressure difference between the cells causing the vent follower to move until it arrives at an equilibrium position. When the vent follower is caused to move the power transfer shaft also moves accordingly. In the rotary version, the vent follower operates in a wiper-type fashion. Movement of the vent follower causes the power transfer shaft to rotate. In the linear version, the power transfer shaft is attached to a piston head. The piston head is fitted into a cylinder which divides the cylinder into two hydraulic or pneumatic cells. The power transfer shaft extends out of one of the cylinders. The position of the vent can be moved to either side of the piston. When the vent is moved to one side of the piston, a pressure imbalance occurs across the piston forcing it to move in the direction of the vent. When the piston moves, the power transfer shaft moves in or out as the case may be.

4 Claims, 10 Drawing Sheets

TORQUE OR FORCE AMPLIFYING ACTUATOR AND METHOD FOR CONTROLLING ACTUATOR

TECHNICAL FIELD

This invention in general relates to a hydraulic or pneumatic control mechanism and specifically to a hydraulic or pneumatic torque or force amplifying actuator and method for controlling said actuator.

BACKGROUND OF THE INVENTION

Amplifying actuators are well known and used for amplifying torque and force in a wide variety of machines. Such actuators commonly are hydraulic driven but can also be pneumatically driven. Representative prior art hydraulic actuators can be either rotary or linear. A simple rotary hydraulic actuator, as illustrated in FIG. 1, amplifies torque via fluid pressure differences acting on a wiper blade 1 connected to a power transfer shaft 2. The fluid pressure in the actuator is controlled using a servo valve with a feedback system arrangement. The wiper blade demarcates two hydraulic cells, 3 and 4. The actuator responds to a command signal 11 to increase the volume of fluid in one of the hydraulic cells, e.g., cell 3. The command signal 11 may or may not be amplified 10 and acts on a servo-valve 7. The servo-valve controls whether each hydraulic fluid line (5 and 6) which services a cell (3 and 4) is an inlet or outlet line. For example, in response to the command signal, the servo-valve may make the hydraulic line servicing cell 3 an inlet line allowing hydraulic fluid to be pumped into cell 3. At the same time the servo-valve made the hydraulic line servicing cell 4 an outlet line. Thus, as fluid volume increases in cell 3, hydraulic fluid is allowed to drain from cell 4. In this way, cell 3 increases in volume and forces the wiper blade to move in the direction of cell 4 as cell 4 decreases in volume. As the position of the wiper blade moves, the power transfer shaft 2, to which it is attached, is rotated. A feedback system, in this case, a potentiometer 9, senses the position of the wiper blade 1 and signals the servo-valve accordingly.

The use of an electronic servo-valve and feedback arrangement to control a hydraulic or pneumatic actuator is widespread. It is preferred because of the fine control such an arrangement affords the positional change of the power transfer shaft. The disadvantage of the electronic servo-valve and feedback arrangement is that it is relatively complex and expensive to manufacture. Manual valve arrangements can also be used as illustrated in U.S. Pat. No. 5,467,800. While the manual valve arrangement tends to be simpler and less expensive to manufacture, manual arrangements generally are unable to provide the fine control the electronic servo-valve arrangement provides. In most cases, manual valve arrangements are limited to several predetermined positions of the power transfer shaft.

The present invention seeks to provide a relatively simple control mechanism for a hydraulic or pneumatic actuator which permits the fine control provided by electronic servo-valve at a fraction of the manufacturing cost.

SUMMARY OF THE INVENTION

The torque amplifying actuator of this invention includes an actuator housing having a cavity which is subdivided into two hydraulic or pneumatic cells. Each cell is supplied by an inlet port through which fluid, in the case of a hydraulic system, or gas, in the case of a pneumatic system, is introduced into the cell. A single vent is located between the cells and drains fluid or gas, as the case may be, from the cells. The vent communicates with an outlet port from the housing. A power transfer shaft extends out from the housing cavity. The shaft is connected to a movable vent follower located at the interface between the cells. The vent position can be changed from an equilibrium position to a nonequilibrium position. At the equilibrium position, the vent and vent follower are in direct relation to one another. In that position, the vent is located at the interface of the two cells. When the vent is moved to a nonequilibrium position, it is located within one of the two cells and is not in direct relation to the vent follower. The cell within which the vent is located begins to drain fluid or gas and a pressure differential occurs between the two cells. The pressure differential forces the vent follower to move toward the vent. As the vent follower moves it also moves the power transfer shaft. Movement of the shaft and vent follower continues until the pressure between the two cells is equalized and the vent follower is once again in direct relation to the vent.

In one aspect of the invention, the torque amplifying actuator is a rotary actuator. In this embodiment the power transfer shaft rotates as the vent follower moves in relation to the change in position of the vent.

In another aspect of the invention, the actuator is a linear actuator.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWINGS

The preferred exemplary embodiment of the present invention will hereinafter be described in conjunction with the appended drawing wherein like designations refer to like elements throughout and in which.

DETAILED DESCRIPTION

The present invention relates broadly to hydraulic or pneumatic torque or force amplifying actuators and methods for controlling such actuators. However, the present invention is most particularly adapted for use in rotary and linear hydraulic actuators. Accordingly, the present invention will now be described in detail with respect to such endeavors; however, those skilled in the art will appreciate that such a description of the invention is meant to be exemplary only and should not be viewed as limitative on the full scope thereof. In particular, it is understood that the use of a gas as opposed to a fluid, such that the actuator is pneumatically rather than hydraulically driven, is squarely within the scope of the invention.

Figure 1:
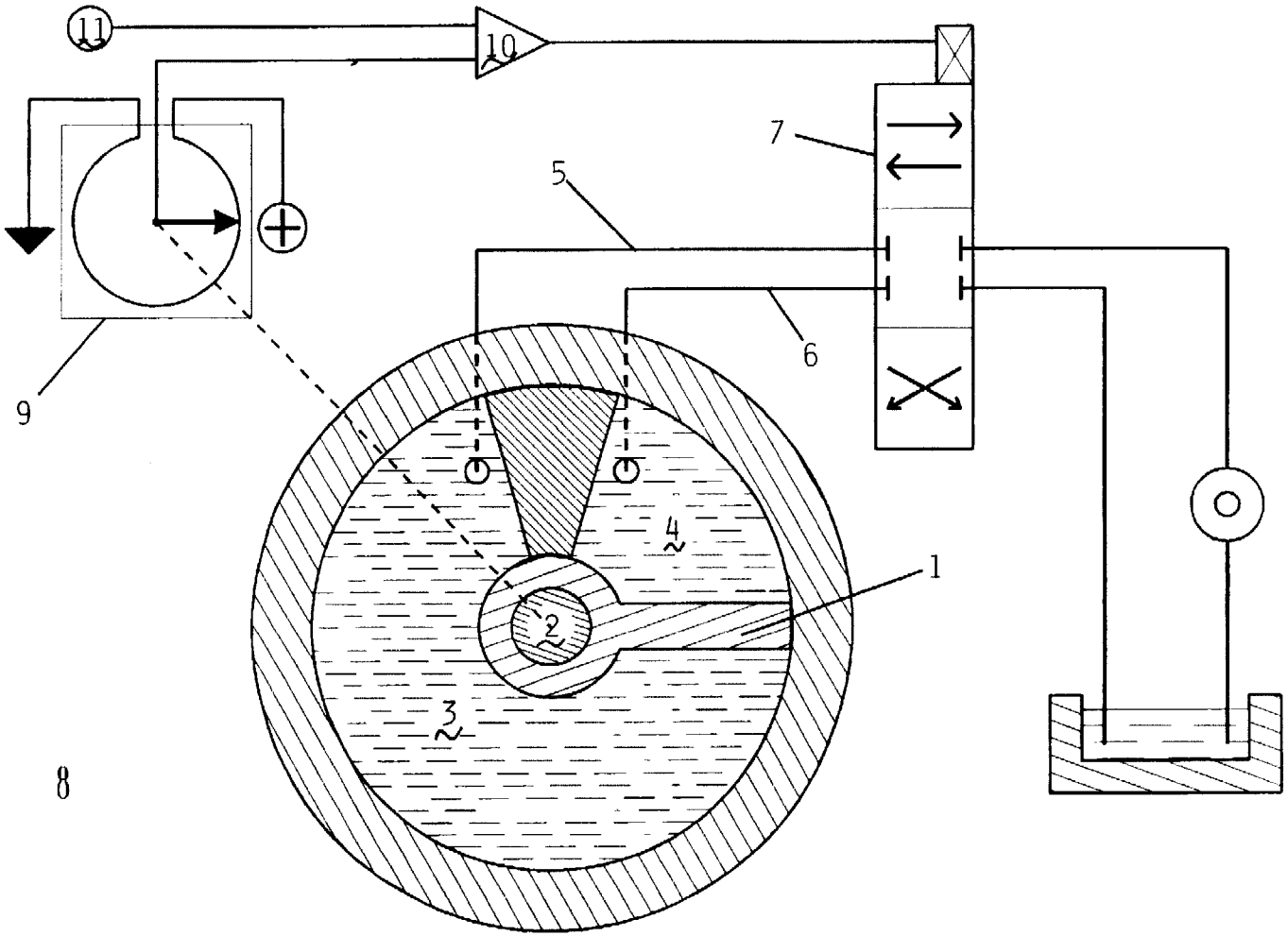
FIG. 1 is a cross-sectional view of a prior art rotary torque amplifying actuator.
Figure 2:
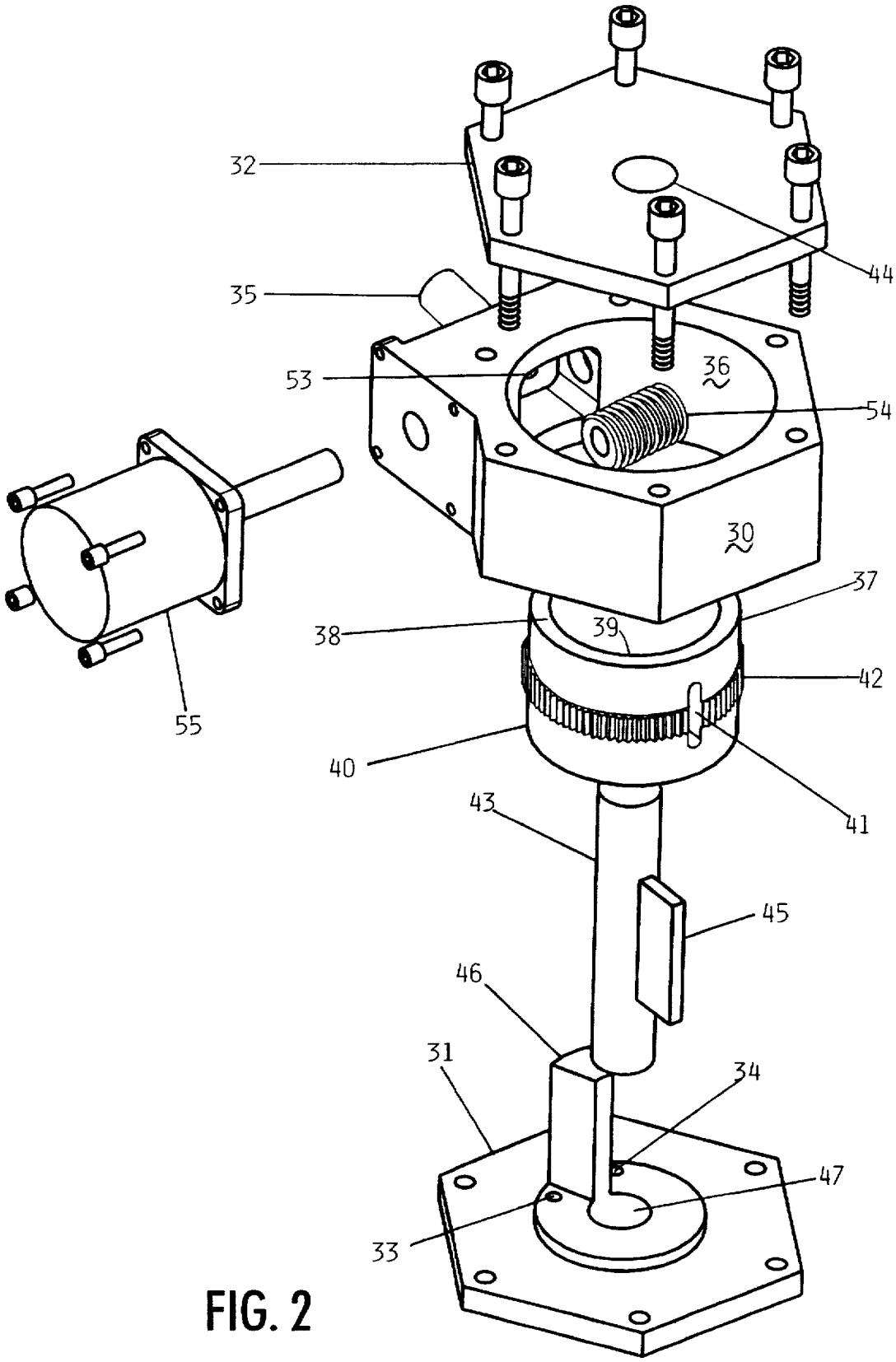
FIG. 2 is an exploded, perspective view of the rotary torque amplifying actuator of the invention.
Figure 3:
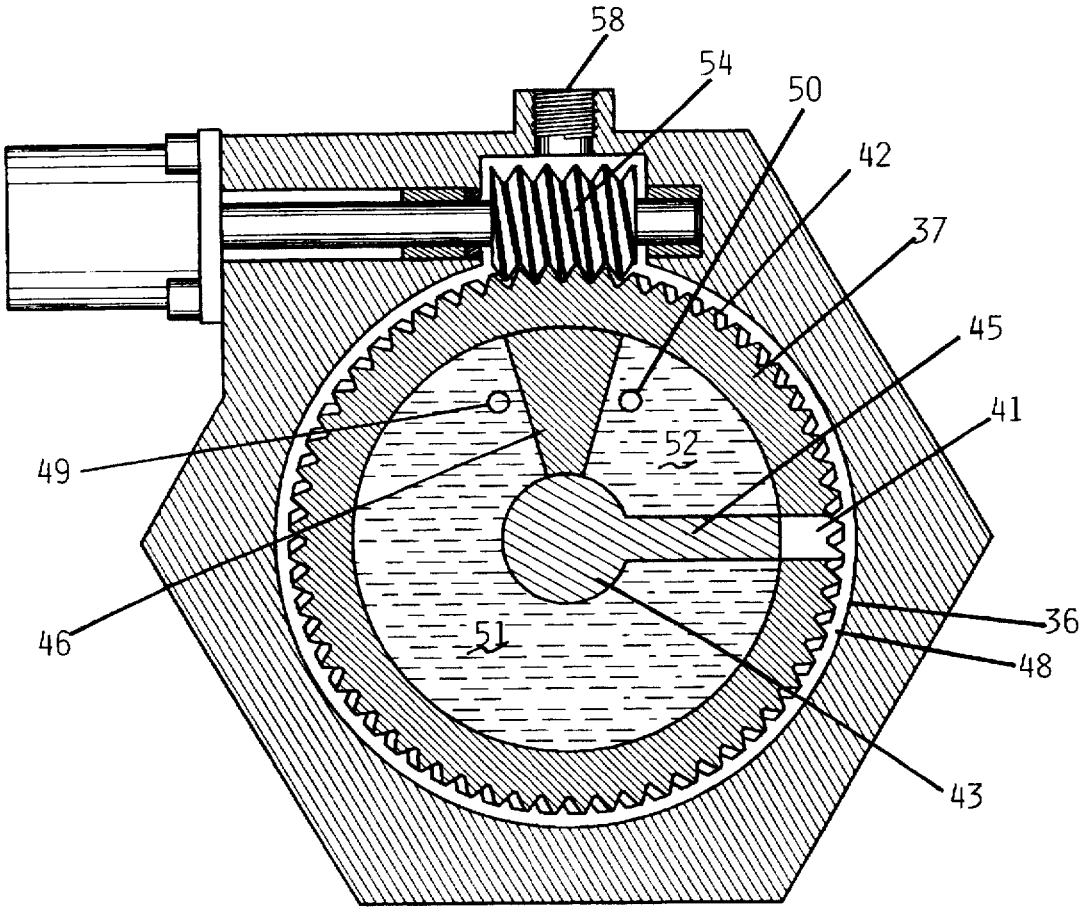
FIG. 3 is a cross-section view of the rotary torque amplifying actuator of the invention.

FIG. 2 is an exploded, perspective view of a first embodiment of the invention. Shown is the rotary, torque amplifying hydraulic actuator of the invention. This preferred embodiment has an actuator housing 30, a bottom plate 31 and top plate 32. The bottom plate has a first inlet port 33, a second inlet port 34. The actuator housing 30 has an outlet port 35. A housing cavity 36 receives a rotatable control ring 37. The control ring 37 has a wall 38 and an inside 39 and outside surface 40. The control ring 37 also has a vent 41 which communicates with the outlet port 35. Formed on the outside surface 40 of the control ring 37 are gear teeth 42. The gear teeth project out from the control ring a slight distance so that a gap exists between the outside surface 37 of the control ring and the cavity 36 wall. The control ring vent 41 empties into this gap, and thus, fluid from the cavity may escape through the vent 41 into the gap and out the outlet port 35. A power transfer shaft 43 is fitted into the middle of the housing cavity 36. The power transfer shaft 43 extends through the hole 44 in the top plate 32. Rigidly attached to the power transfer shaft 43 is a vent follower 45. A divider 46 is fastened to the bottom plate 31. The divider has a seat 47 for the power transfer shaft 43 and openings for the first and second inlet ports (33 and 34). When assembled, the divider is positioned between the power transfer shaft 43 and the inside surface 39 of the control ring 37. The divider 46 and vent follower 45 each form a seal between the power transfer shaft 43 and the inside surface 39 and the bottom plate 31 and top plate 32. In this way, the combination of the divider 46, the power transfer shaft 43 and the vent follower 45, as illustrated in FIG. 3, divide the cavity 36 into a first hydraulic cell 51 and a second hydraulic cell 52. The actuator housing 30, provides a sleeve 53 into which a worm gear 54 is fitted. The worm gear 54 interacts with the gear teeth 42 of the outside surface 40 of the control ring 37 so as to provide a means to rotate the control ring 37. The worm gear is driven by a stepper motor 55. Alternatively, the worm gear could be driven by a servo-motor or could be manually driven.

FIG. 3 is a cross-sectional view of the rotary, torque amplifying hydraulic actuator of the invention. This view shows the interaction of the worm gear 54 with the gear teeth 42 of the control ring 37. This view also illustrates how the combination of the divider 46, power transfer shaft 43 and vent follower 45 divide the cavity into a first hydraulic cell 51 and second hydraulic cell 52. The vent 41 in the control ring 37 is illustrated with the vent follower 45 directly opposite. FIG. 3 also illustrates that a gap 48 is found between the inside wall of the cavity 36 and the outside surface of the control ring 37.

Figure 4A:
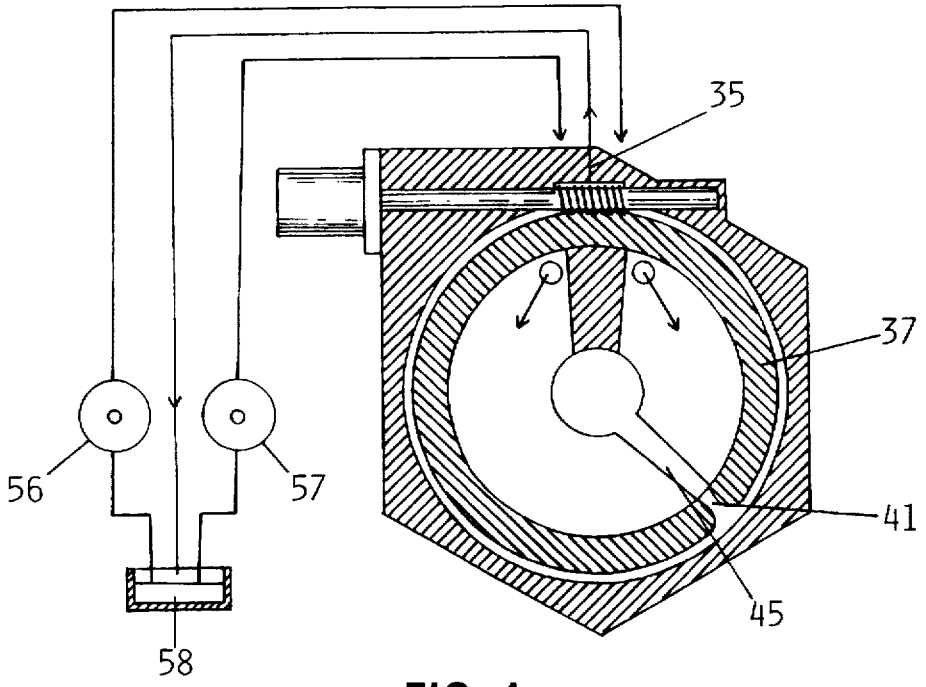
FIGS. 4*a* to 4*d* are cross-sectional views of the rotary torque amplifying actuator of the invention at various positions of its operation.
Figure 4B:
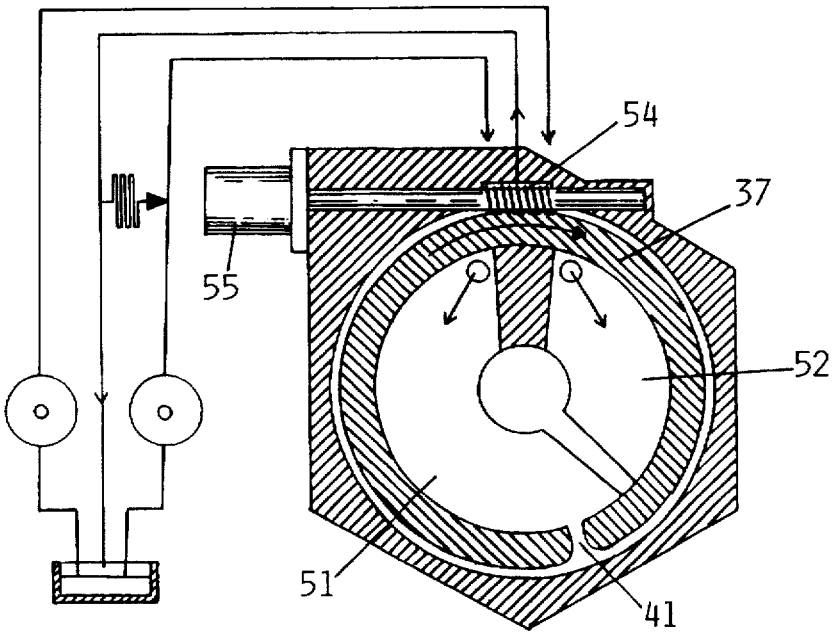
Figure 4C:
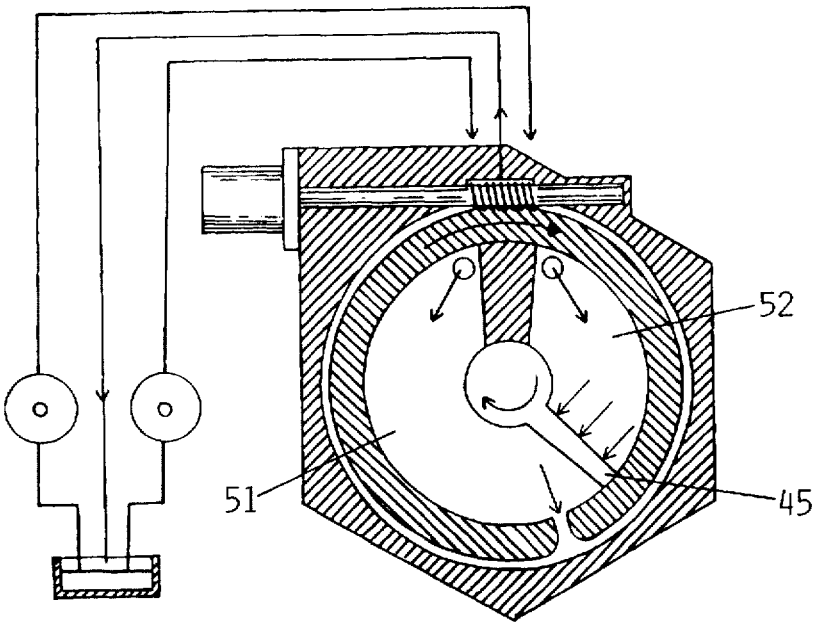
Figure 4D:
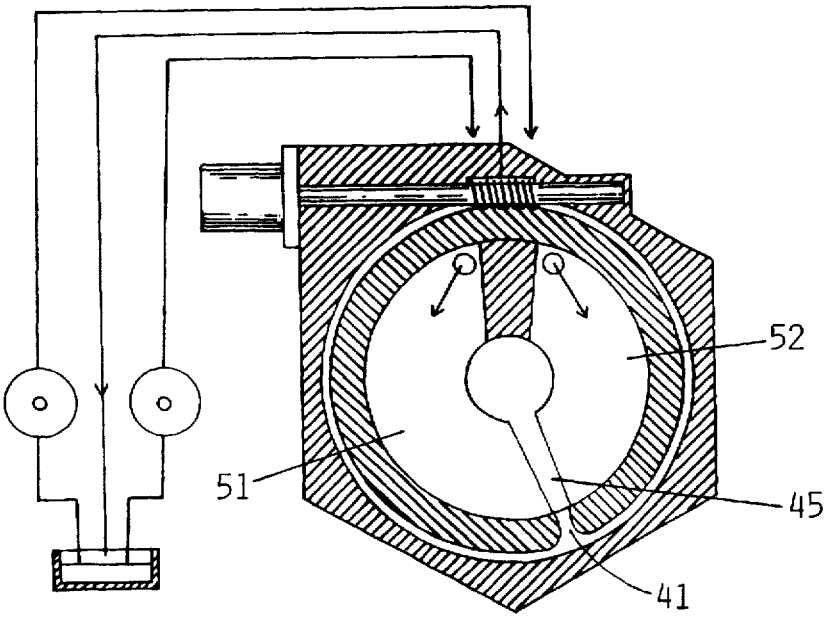

FIGS. 4*a* through 4*d* are cross-section views illustrating how the actuator of the invention works. This view also illustrates that the inlet ports are served by a first hydraulic pump 56 and second hydraulic pump 57 and the outlet port 35 drains into an hydraulic reservoir 58 In FIG. 4*a*, the actuator is at equilibrium, and it can be seen that the vent follower 45 rests over the vent 41 of the control ring 37. In FIG. 4*b* the stepper motor 55 was activated causing the worm gear 54 to drive the control ring 37 in a clockwise rotation. This causes the vent 41 to move from the position opposite the vent follower 45 to a nonequilibrium position in the first hydraulic cell 51. In the nonequilibrium position, the vent 41 is not covered and hydraulic fluid escapes from the first hydraulic cell 51 into the gap 48 to the outlet port 35 emptying into the reservoir 58. This causes a pressure drop in the first hydraulic cell 51. At the same time, no outlet is provided the second hydraulic cell 52, and fluid pumped into the second hydraulic cell 52 from the second face port 50 causes pressure in the second hydraulic cell 52 to increase. As seen in FIG. 4*c*, the imbalance in pressures between the first hydraulic cell 51 and second hydraulic cell 52 causes the vent follower 45 to move toward the first hydraulic cell 51. As the vent follower 45 is rigidly attached to the power transfer shaft 43, the shaft also rotates in a clockwise rotation and thus amplifies torque. FIG. 4*d* illustrates that the vent follower 45 has returned to an equilibrium position which locates it opposite the vent 41. This position occurs when pressure across the vent follower has equalized. The equilibrium position either blocks further escape of fluid from cell 51 or permits minor but equal leakage from both cell 51 and 52. Regardless, in the equilibrium position further movement of the vent follower 45 or rotation of the power transfer shaft 43 ceases.

Numerous modifications could be made to the structural elements of the above-described rotary torque amplifying actuator which the present inventor would consider equivalent. For example, the above-described preferred embodiment moves the vent position from an equilibrium position to a nonequilibrium position by means of a control ring within which the vent is located. An alternative and equivalent means would be to provide a movable top or bottom plate within which the vent is located. Another alternative and equivalent means of changing the position of the vent would be to locate a series of vent openings at predefined positions within each cell. A valve arrangement would permit only one of the vents to be open at any one time, and thus, the operative vent position could be changed from an equilibrium position to a nonequilibrium position through closing an opening of vent valves. Alternatively, one may wish to control each vent valve separately so that more than one vent at a time can be opened. This flexibility would permit, for example, accelerating the change in pressure drop in a cell by opening more than one vent in that cell. Such valves could be controlled by a number of different means. For example, such valves could be manually controlled. Alternatively, they could be controlled by an electronic mechanism such as an electronic-solenoid valve.

Figure 5:
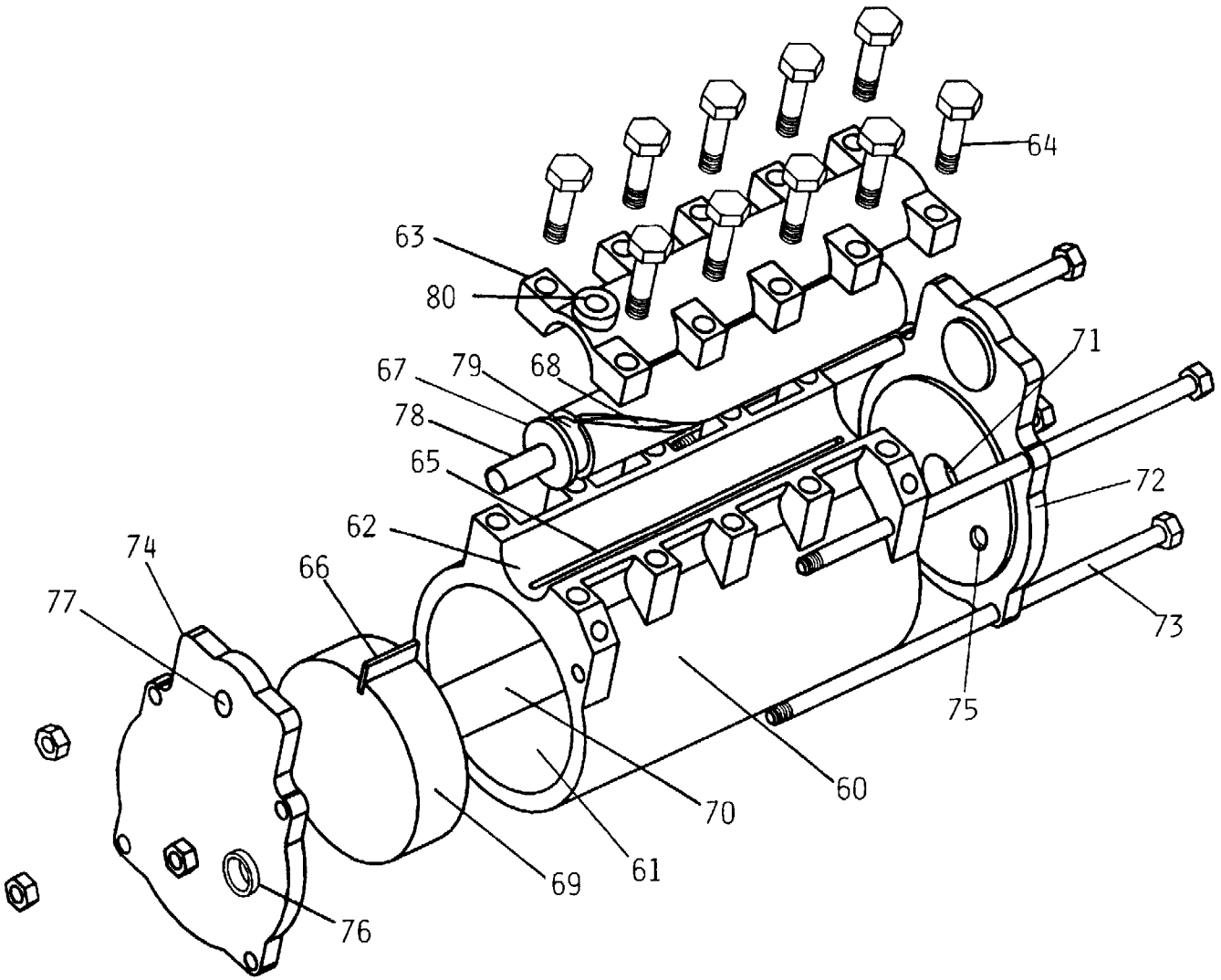
FIG. 5 is a perspective exploded view of the linear force amplifying actuator of the invention.

FIG. 5 is a perspective, exploded view of the second embodiment of the invention. The actuator housing 60 comprises a first cylinder 61 joined to a smaller second cylinder 62. The second cylinder 62 is formed by attaching the second cylinder head 63 with bolts 64. It is preferred to provide a gasket between the cylinder head 63 and actuator housing to prevent leakage. The common wall between the two cylinders contains a slotted vent 65 into which the vent follower 66 fits. The control rod 67 has a helically swept channel 68 in its exterior and fits into the second cylinder 62. A piston head 69 which is circular and plate-shaped is connected to the power transfer shaft 70. The piston head 69 and power transfer shaft 70 fit into the first cylinder 61. The power transfer shaft extends through a shaft opening 71 in the top plate 72. A gasket or O-ring may be used in the shaft opening 71 to prevent leakage around the power transfer shaft 70. The top plate 72 fits over one end of the first and second cylinders (61 and 62) and is secured by long bolts 73 to a bottom plate 74 which fits over the other end of the first and second cylinders (61 and 62). The top plate 72 has a first inlet port 75 and the bottom plate 74 has a second inlet port 76. The bottom plate also has a control shaft opening 77 through which the control shaft 78, which is connected to the control rod 67, fits. The control shaft may be connected to a stepper motor, a mechanical linkage, or may be manually turned. The power transfer shaft attaches to whatever the user wishes to be pushed and pulled. The control rod 68 has a recessed area 79 into which feeds the helically swept channel 68. The cylinder head 63 has an outlet port 80 which is positioned over the recessed area 79 when the control rod 67 is fitted into the second cylinder 62 and the cylinder head 63 is fastened to actuator housing 60.

Figure 6A:
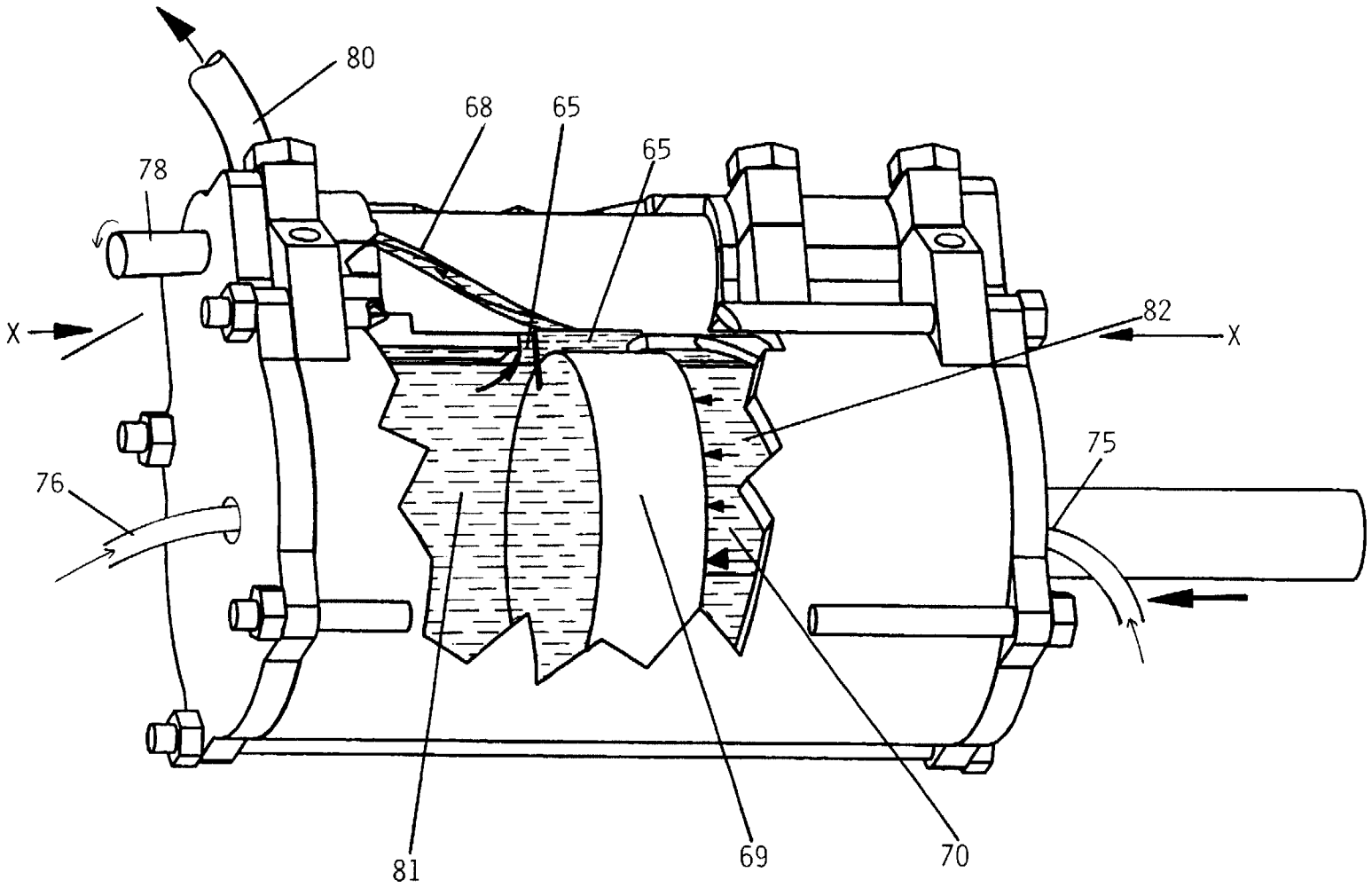
FIGS. 6*a* to 6*b* are cut-away perspective views of the linear force amplifying actuator of the invention.
Figure 6B:
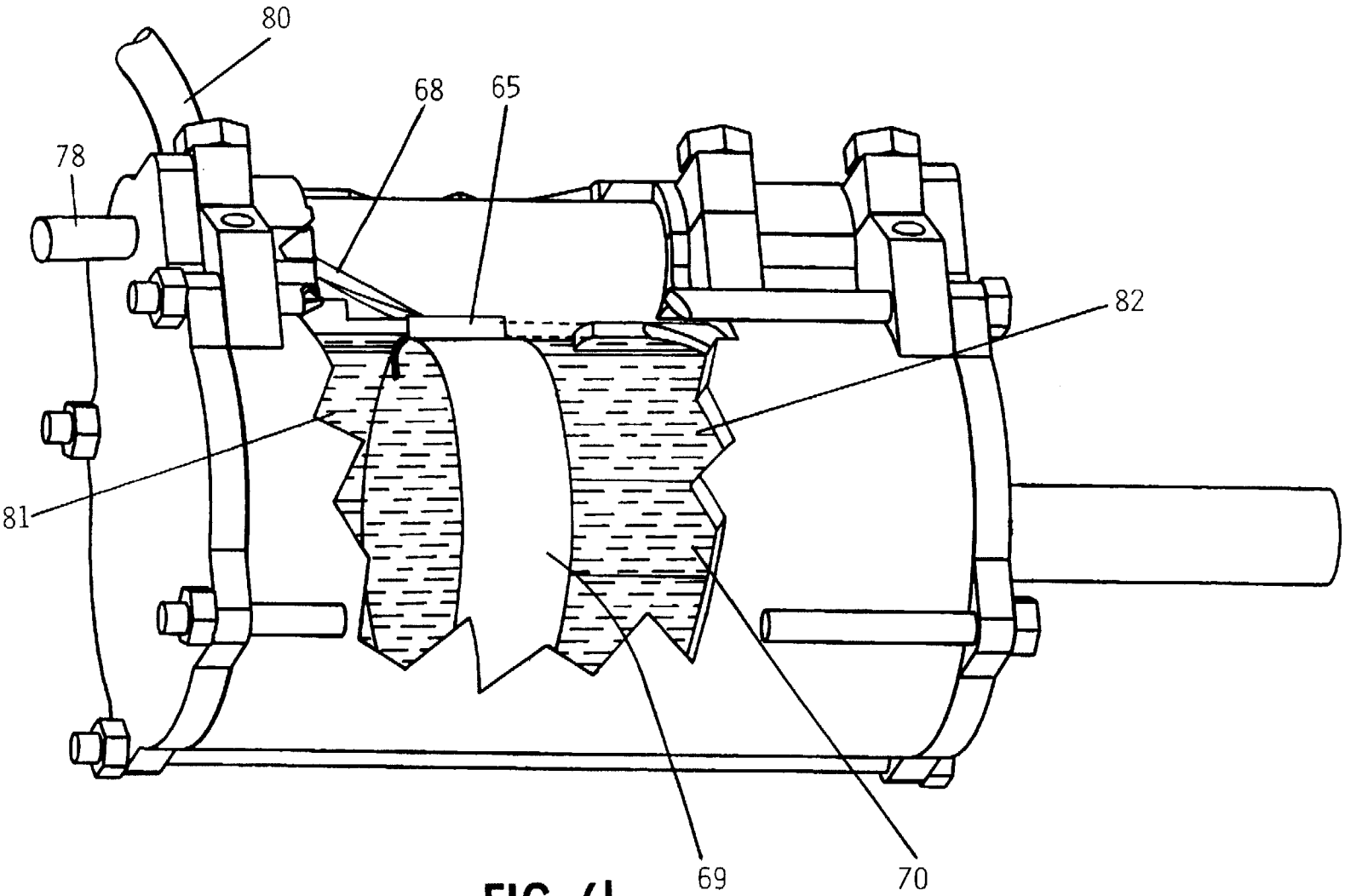

FIGS. 6*a* and 6*b* illustrate how the second embodiment of the invention works. As can be seen in FIG. 6*a*, the piston head 69 and power transfer shaft 70 is inserted into the first cylinder 61. The fit between the piston head 69 and the inside wall of the first cylinder 61 is sufficiently snug so that a seal is created between the first cylinder 61 wall and piston head 69, yet not so snug as to prevent the piston from freely moving in and out. The piston head divides the first cylinder into two hydraulic cells, a first hydraulic cell 81 and a second hydraulic cell 82. At each end of the first cylinder an inlet port (75 and 76) allows hydraulic fluid to be introduced into the first and second hydraulic cells (69 and 70). The control rod 67 is fitted into the second cylinder 62. The fit of the control rod 67 is sufficiently snug that a seal is created between the second cylinder 62 inside wall and the control rod 67, yet not so snug as to prevent the control rod 67 from being rotated.

The seal made between the control rod 67 and the inside wall of the second cylinder 62 closes off the slotted vent 65 except at the point where the helically swept channel 68 is directly opposite the slotted vent 65. At that point, fluid may pass through the vent 65, along the helically swept channel 68 and out the outlet port 80. This creates a nonequilibrium condition as pressure drops in the vented cell, in this case 81, while pressure increases in cell 82. The difference in pressure across the piston head forces the head to move in the direction of cell 81. As the piston head 69 moves, the vent follower 65 also moves until the vent follower 65 is positioned directly opposite the helically swept channel 68 as illustrated in FIG. 6*b*.

FIG. 6*b* illustrates the position the piston head 69 is forced to move to when the conditions of 6*a* are created. When movement of the piston head 69 is completed, the piston head 69 is in the equilibrium position. In an equilibrium position, the vent follower 65 is located opposite the helically swept channel 68. In this position, access to the helically swept channel 68 through the slotted vent is sealed off by the vent follower 65 and pressures across the piston head 69 are equalized. To move the power transfer shaft farther in or out, the control rod shaft must be rotated clockwise or counterclockwise, respectively.

Figure 7A:
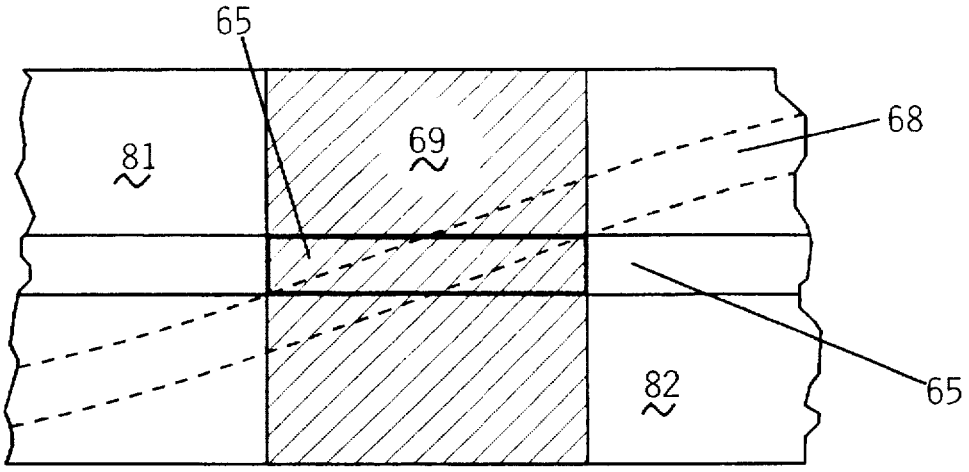
FIGS. 7*a* to 7*c* are cross-section views made approximately in the plane marked with X in FIGS. 6*a* and 6*b* of the linear force amplifying actuator of the invention.
Figure 7B:
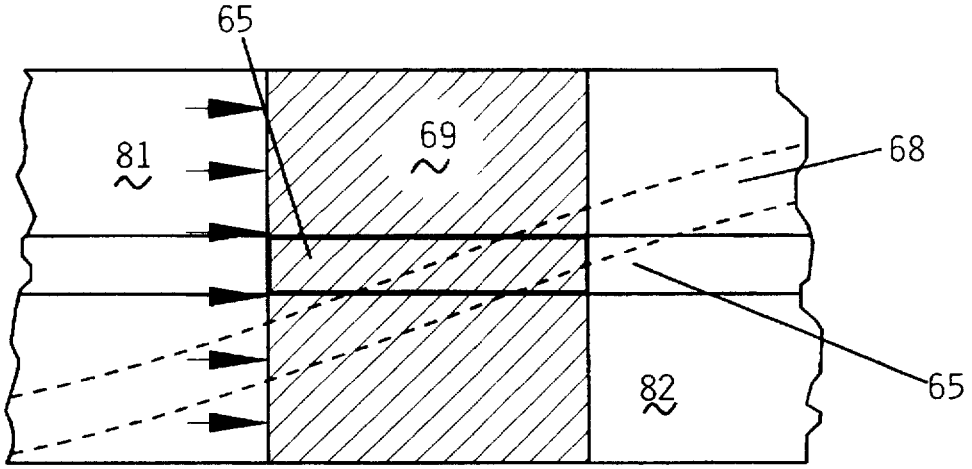
Figure 7C:
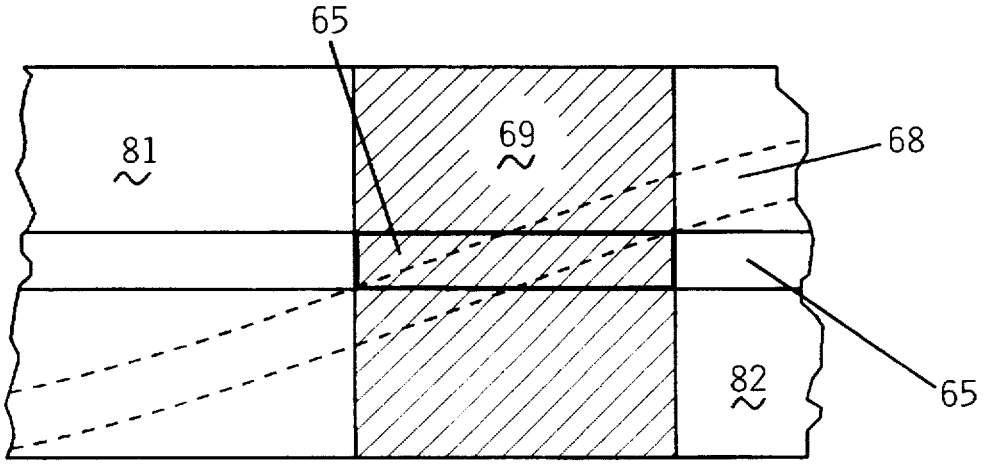

FIGS. 7*a* through 7*c* are partial sectional views through the plane of x as indicated in FIG. 6*a*. As can be seen in FIG. 7*a*, a section of the vent follower 66 is seen, below which is the section of the piston head 69. The vent follower 66 slides within the slotted vent 65. On either side of the piston head 69 is a hydraulic cell (81 and 82). The path of the helically swept channel 68 is seen as a double dotted line. In FIG. 7*a* the piston head 69 and vent follower 66 is in an equilibrium position. The path of the helically swept channel crosses the slotted vent 65 in the area where the slotted vent 65 is occupied by the vent follower 66.

If one rotates the control rod shaft in a clockwise direction, the path of the helically swept channel 68 is shifted such that it crosses the slotted vent 65 in cell 82 and at a portion of the slotted vent 65 which is not occupied by the vent follower 66. This is illustrated in FIG. 7*b*. That portion of the helically swept channel which crosses the slotted vent provides a vent opening for hydraulic fluid in cell 82. In this position fluid escapes from cell 82 through the slotted vent 65 into the helically swept channel 68 and out the outlet port. When this happens, pressure drops in cell 82, and a pressure difference occurs across the piston head 69. This pressure difference forces the piston head 69 and vent follower 66 to move toward cell 82 until the vent follower occupies the vent opening, closing off the escape of fluid from cell 82. At this position, pressure becomes equalized across the piston head and movement stops. This is illustrated in FIG. 7*c* which describes an equilibrium position for the actuator of the invention.

Figure 8:
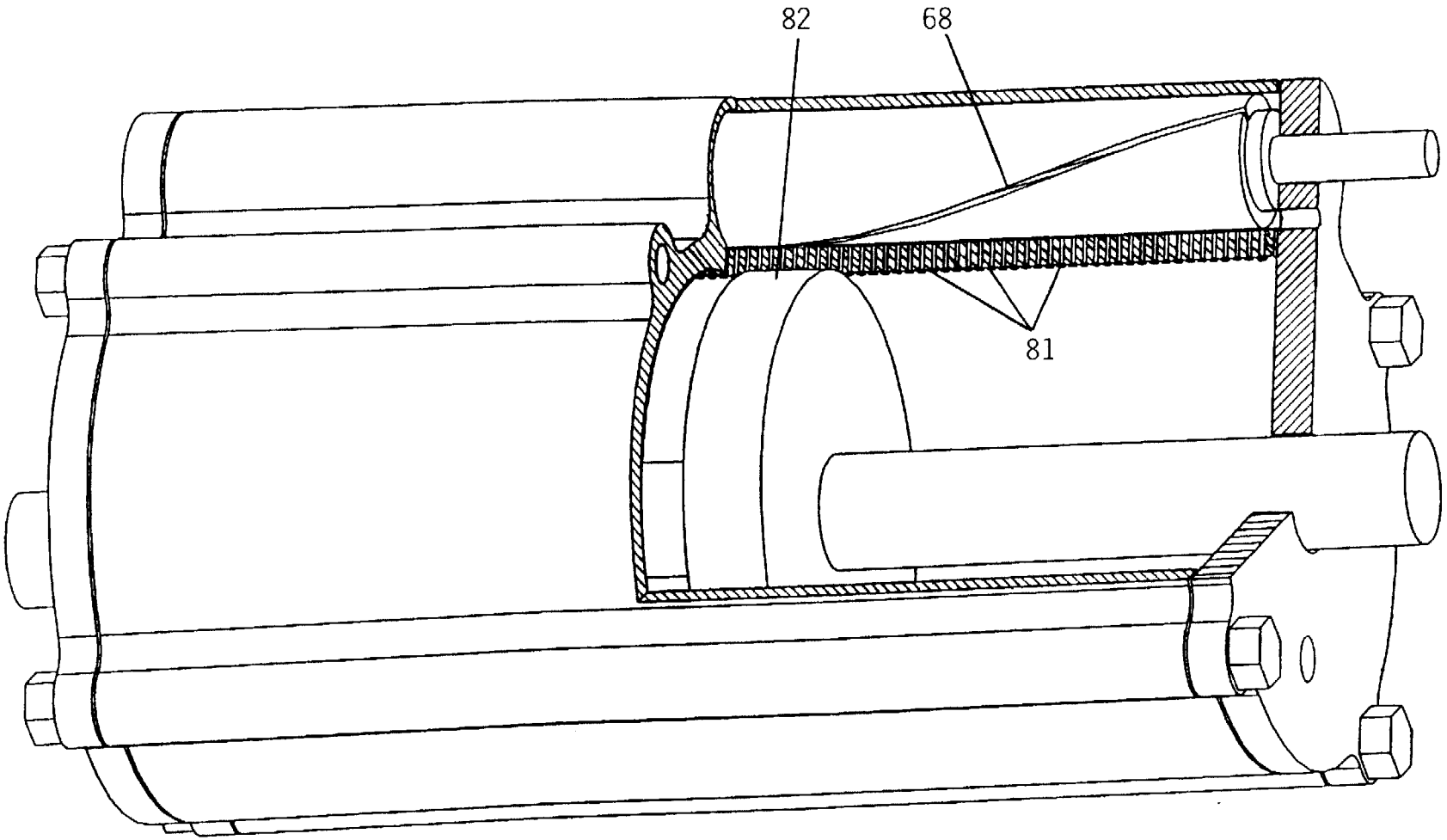
FIG. 8 is a cut-away perspective view of an alternate embodiment of the linear force amplifying actuator of the invention.

As illustrated in FIG. 8 an alternative embodiment of the linear, force amplifying actuator of the invention has, in place of the slotted vent, linearly arranged separate vent holes 81 between the first cylinder and the second smaller cylinder. Such an arrangement would not have a vent follower as illustrated in FIGS. 5 through 7. Rather, the piston head 82 itself would close a vent hole and prevent escape of fluid into the helically swept channel 68.

A further alternative embodiment of the linear, force amplifying actuator of the invention would have vent holes positioned at discrete locations along a line. In such an arrangement, the control rod may have more than one helically swept channel running parallel to one another about the control rod. Variations of such an arrangement would allow presetting the control rod shaft rotation to define positions which open and close vents in specific locations along a line. Such a design produces an actuator which moves the power transfer shaft in and out in predefined lengths and locations.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

I claim:

1. A hydraulic actuator, comprising:

(a) a housing having a housing cavity and a top plate and bottom plate enclosing said cavity, said housing having a first and second inlet port and an outlet port from said cavity;

(b) a control ring having a wall with an inside and outside surface, said control ring rotatably fitted into said housing cavity, said control ring having a vent in said wall, said vent communicating with said outlet port;

(c) a rotatable power transfer shaft positioned in the center of said ring, said shaft extending through at least one of said top plate or bottom plate;

(d) a divider extending between said shaft and said inside surface and said top plate and bottom plate, said divider forming a seal at said inside surface and said top plate and bottom plate;

(e) a vent follower which moves in relation to said vent position, said follower rigidly attached to said shaft so as to rotate said shaft when said vent follower moves, said vent follower extending between said shaft and said inside surface and said top and bottom plate, said vent follower forming a movable seal at said inside surface and said top and bottom plate;

(f) a means to rotate said control ring so as to change the position of said vent.

2. A hydraulic actuator as claimed in claim 1, wherein said means to rotate said control ring is a stepper motor.

3. A hydraulic actuator as claimed in claim 2, wherein the outside surface of said control ring contains gear teeth, and said stepper motor comprises a worm drive, said worm drive interacting with said gear teeth.

4. A hydraulic actuator as claimed in claim 1, further comprising: at least one hydraulic pump which is connected to said first and second inlet ports; and a hydraulic reservoir which is connected to said outlet port.

* * * * *